US005149905A

United States Patent [19]

Count

[11] Patent Number: 5,149,905

[45] Date of Patent: Sep. 22, 1992

[54] MOVEABLE MUSICAL INSTRUMENT SUPPORT APPARATUS

[76] Inventor: William S. Count, 427 Roberts Rd., Pacifica, Calif. 94044

[21] Appl. No.: 405,760

[22] Filed: Sep. 11, 1989

[51] Int. Cl.[5] ..... G10H 3/00; G10H 1/32

[52] U.S. Cl. ..... 84/744; 84/327; 248/122; D17/99

[58] Field of Search ..... 84/174, 177, 327, 329, 84/467, 470 R, 600–606, 615, 626, 644, 645, 647, 701, 718, 719, 670, 744, 743, DIG. 3, 180, 441, 464 R, 464 A; 248/121, 122, 123.1; D17/1, 2, 4, 9, 99; 381/76

[56] References Cited

U.S. PATENT DOCUMENTS

| | | | |
|---|---|---|---|
| D. 307,760 | 5/1990 | Ryan | D17/1 X |
| 2,263,668 | 11/1941 | Woodworth | 381/169 X |
| 2,830,118 | 4/1958 | Kohler | 381/76 |
| 3,665,490 | 5/1972 | Oskar | 84/329 X |
| 4,331,062 | 5/1982 | Rogers | 84/470 R X |
| 4,501,201 | 2/1985 | Fitzner et al. | 248/230 X |
| 4,550,638 | 11/1985 | Kaneko et al. | 84/DIG. 3 X |
| 4,579,229 | 4/1986 | Porcaro et al. | 248/166 X |
| 4,754,711 | 7/1988 | Solomon | 248/122 X |
| 4,770,380 | 9/1988 | Eason et al. | 248/165 |

*Primary Examiner*—William M. Shoop, Jr.
*Assistant Examiner*—Jeffrey W. Donels
*Attorney, Agent, or Firm*—Flehr, Hohbach, Test, Albritton & Herbert

[57] ABSTRACT

A movable musical instrument support apparatus is disclosed. The apparatus includes a central vertical support. A musical instrument is positioned at one end of the central vertical support. A boom assembly supporting a microphone is positioned at the same end of the central support. A base support including a number of wheels is positioned at the other end of the central support. A push cable is attached to the base support, this push cable enclosed a cable used in relation with the musical instrument. The push cable extends from the leg and therefore prevents the wheels from running over the cable. Lights are positioned along the central support for illuminating the area adjacent to the musical instrument.

8 Claims, 2 Drawing Sheets

MOVEABLE MUSICAL INSTRUMENT SUPPORT APPARATUS

BRIEF DESCRIPTION OF THE INVENTION

This invention relates generally to a support apparatus for musical instruments. More particularly, it relates to a support apparatus for musical instruments which allows a performer to move an instrument around stage without hindrance from lack of lighting, instrument cables, or the absence of a microphone.

BACKGROUND OF THE INVENTION

Many musical instruments, for instance keyboards, require a stand to place the instrument at a proper position for performance. These stands are generally stationary in nature. As a result, the musician performing on such an instrument is required to stay in one location during a concert. This decreases the visibility of the musician and diminishes the opportunity for on-stage entertainment.

Attempts to increase the mobility of stand-supported musical instruments have encountered a number of difficulties. One problem associated with attempting to make a mobile stand support for a musical instrument relates to providing an unobstructed path for the wheels of the stand. Specifically, the musical instrument may require connection with a number of cables, for instance, a power cable or a microphone cable. These cables tend to obstruct any path through which the instrument will be moved. That is, the wheels of a mobile stand will be blocked by the cables.

Another problem associated with a mobile music stand relates to providing proper lighting to direct any movement of the stand. Many musical performances transpire on a stage with limited lighting. This lack of lighting prevents even a mobile music stand from being successfully moved around stag since it is unclear to the performer where the instrument may be moved.

If the instrument stand is movable, still another problem arises in relation to providing a microphone for the performer. Microphones are generally positioned in stationary stands, if the performer moves about stage, proximity to the stationary microphone will be lost.

OBJECTS AND SUMMARY OF THE INVENTION

Thus, it is a general object of the present invention to provide a movable musical instrument support apparatus.

It is a related object of the present invention to provide a musical instrument support apparatus which includes a number of wheels to enable mobility of the support apparatus.

It is another object of the present invention to provide a mechanism which prevents the cables associated with the musical instrument from obstructing the path of the mobile support apparatus.

It is still another object of the present invention to provide a musical instrument support apparatus which illuminates the area adjacent to the instrument and therefore allows the performer to select unobstructed paths for movement of the instrument.

It is yet another object of the present invention to provide a musical instrument support apparatus which maintains the performer's microphone in close proximity to the performer, regardless of the location of the musical instrument.

These and other objects are achieved by a movable musical instrument support apparatus. The apparatus includes a central vertical support. A musical instrument is positioned at one end of the central vertical support. A boom assembly supporting a microphone is positioned at the same end of the central support. A base support is positioned at the other end of the central support. The base support includes a number of wheels. A push cable is attached to the base support, this push cable encloses a cable used in connection with the musical instrument. The push cable extends from the base support and therefore prevents the wheels from running over the cable. Lights are positioned along the central support for illuminating the area adjacent to the musical instrument. These features allow the instrument to be conveniently moved on stage during a performance. That is, the wheels allow the instrument to be moved, the boom assembly maintains the microphone's position close to the performer, the push cable prevents the wheels from obstructing the path of the wheels, and the lights provide illumination to allow the performer to determine which direction to move.

BRIEF DESCRIPTION OF THE DRAWINGS

Other objects and advantages of the invention will become apparent upon reading the following detailed description and upon reference to the drawings, in which.

DETAILED DESCRIPTION OF THE INVENTION

Figure 1:
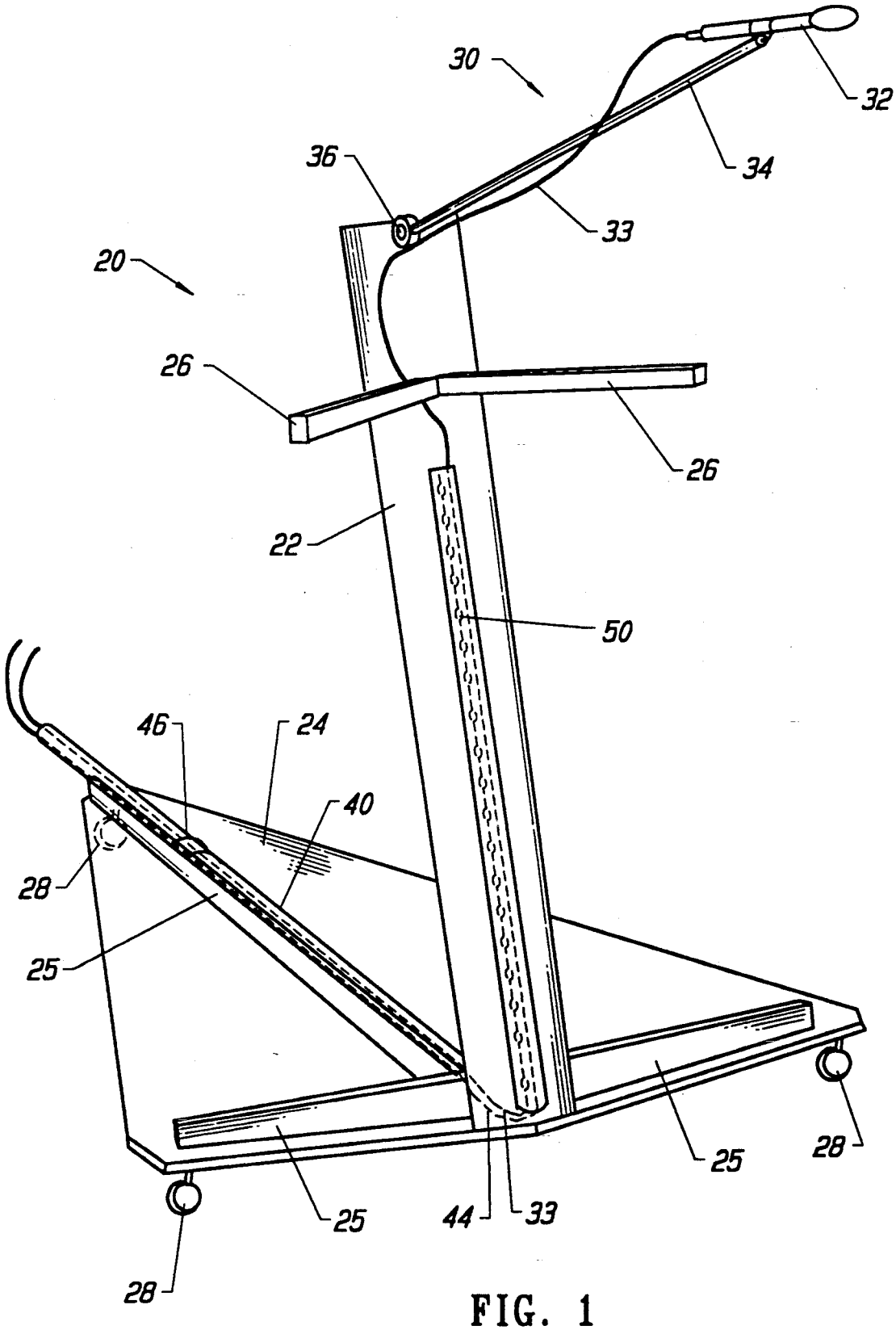
FIG. 1 is a front perspective view of a movable musical instrument support apparatus in accordance with the present invention.
Figure 2:
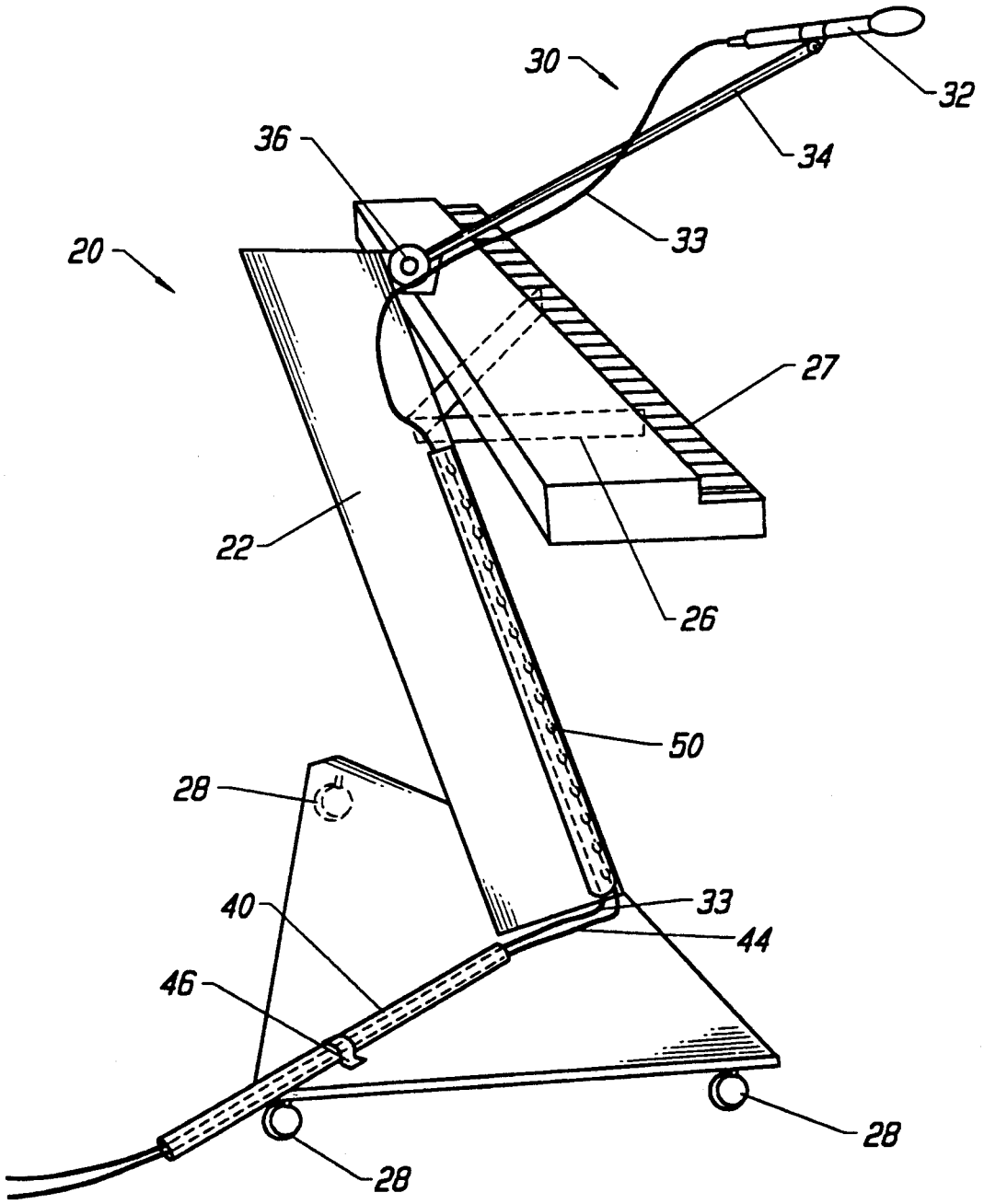
FIG. 2 is a side perspective view of a movable musical instrument support apparatus in accordance with the present invention.

Turning now to the drawings, like components are designated by like reference numerals in the two figures. FIG. 1 and FIG. 2 depict a movable musical instrument support apparatus 20 in accordance with the present invention. The movable support apparatus 20 includes a central vertical support 22 which serves as a support for a musical instrument. At the bottom of the central support 22 is a base support 24. As depicted in FIG. 1, base support 24 is a triangular base attached to three legs 25. Base support 24 may simply be three legs, as is known in the art.

Near the top of the central support 22, are arms 26 which function to hold a musical instrument. Keyboard 27, by way of example, is depicted as resting on arms 26, in FIG. 2.

In accordance with the present invention, a number of wheels 28 are affixed to base support 24. Preferably, three casters are attached to the base support 24 by conventional means. Thus, pursuant to the present invention, a movable musical instrument support apparatus is provided.

The present invention may also include a microphone boom assembly 30. The boom assembly 30 includes a microphone 32, a boom 34, and a clamp 36 which holds boom 34. In FIGS. 1 and 2, boom assembly 30 is positioned at the top of central support 22. Naturally, the boom assembly need not be placed at that specific location. Thus, in accordance with the present invention, the boom assembly, being integrally attached to the movable instrument support apparatus 20, allows a performer to remain in proximity to the microphone 32, regardless of the location of the support apparatus 20.

Another feature of the invention is push cable 40, which is positioned on base support 24 and extends from the perimeter thereof. Push cable 40 preferably encloses the cables which are associated with the musical instrument placed on the support apparatus 20. Thus, microphone cable 33, would be considered one such cable. As to be more fully described herein, light cable 44 would be another cable which may be enclosed by push cable 40. Similarly, the power cable to the instrument, or any other cable associated with the instrument may be enclosed in the push cable 40.

The push cable 40 may be formed of vinyl tubing. The push cable 40 is preferably secured to the base support 24 by tubing attachment 46.

The push cable 40 serves to position the cables away from the wheels 28, as depicted in the figures. Specifically, by keeping the cables extended from the perimeter of the base support 24, the cables do not obstruct the wheels 28, when the support apparatus 20 is moved from one position to another.

Yet another feature of the present invention is light source 50. In the figures, light source 50 is depicted as being positioned along the longitudinal axis of central support 22. In one embodiment of the present invention, a 40 inch strip of 110 volt lights may be used as the light source 50, the lights may be positioned within vinyl tubing. The light cable 44 associated with light source 50 is preferably positioned within push cable 40.

Thus, light source 50 illuminates an area adjacent to the support apparatus 20. This allows a performer to view the immediate area and determine which direction the support apparatus 20 may be directed.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

I claim:

1. A movable musical instrument support apparatus comprising:

a central support including a first end and a second end;

means for supporting a musical instrument, said means being positioned proximate to said first end of said central support;

a boom assembly for supporting a microphone, said boom assembly being positioned proximate to said first end of said central support;

a base support including a plurality of wheels positioned at said second end of said central support;

a push cable, said push cable enclosing a functional cable used in relation to said musical instrument, said push cable being coupled to said base support and extending from the perimeter of said base support; and light means positioned along said central support for illuminating the area adjacent to said musical instrument.

2. A movable musical instrument support apparatus comprising:

a central support including a first end and a second end;

means for supporting a musical instrument, said means being positioned proximate to said first end of said central support;

a base support including a first side, a second side, and an outer perimeter, said first side of said base support being coupled to said second end of said central support, said second side of said base support including a plurality of wheels; and a push cable, said push cable enclosing a functional cable used in relation to said musical instrument, said push cable being positioned on said first side of said base support and extending from said perimeter of said base support to avoid contact with said wheels.

3. The apparatus of claim 2 further comprising means for illuminating the area adjacent to said base support.

4. The apparatus of claim 3 further comprising means for supporting a microphone.

5. A movable musical instrument support apparatus comprising:

means for supporting a musical instrument, said means including a first end and a second end, said musical instrument being supported proximate to said first end;

a base structure with an outer perimeter, said base structure being coupled to said second end of said supporting means, said base structure including a plurality of wheels; and means for positioning a cable, used in connection with said musical instrument, outside said perimeter of said base structure so as to position said cable away from said wheels of said base structure.

6. The apparatus of claim 5 further comprising means for illuminating the area adjacent to said base structure.

7. The apparatus of claim 6 wherein said positioning means is vinyl tubing coupled to said base structure and extending from said perimeter of said base structure.

8. The apparatus of claim 7 further comprising means for supporting a microphone.

* * * * *